US006343947B1

(12) United States Patent
Byrne

(10) Patent No.: US 6,343,947 B1
(45) Date of Patent: Feb. 5, 2002

(54) MOUNTING ASSEMBLY WITH DUAL ENTRY CANTILEVER LATCH

(76) Inventor: Norman R. Byrne, 2736 Honey Creek, NE., Ada, MI (US) 49301

( * ) Notice: Subject to any disclaimer, the term of this patent is extended or adjusted under 35 U.S.C. 154(b) by 0 days.

(21) Appl. No.: 09/481,470

(22) Filed: Jan. 11, 2000

(51) Int. Cl.[7] ..... H01R 13/627

(52) U.S. Cl. ..... 439/357; 439/540.1; 220/3.9

(58) Field of Search ..... 439/215, 216, 439/211, 357, 535–539, 557, 540.1; 220/3.2–3.9

(56) References Cited

U.S. PATENT DOCUMENTS

| | | | |
|---|---|---|---|
| 2,023,083 | A | 12/1935 | Knell |
| 2,160,713 | A | 5/1939 | Bentley |
| 3,250,558 | A | 5/1966 | McClintock |
| 3,316,624 | A | 5/1967 | Brudevold |
| 3,573,716 | A | 4/1971 | Garver |
| 3,617,989 | A | 11/1971 | Heath |
| 3,812,450 | A | 5/1974 | Simovits, Jr. |
| 3,970,276 | A | 7/1976 | Debaigt |
| 3,989,343 | A | 11/1976 | Lucius |
| 4,062,470 | A | 12/1977 | Boteler |
| 4,214,668 | A | 7/1980 | Neff |
| 4,277,123 | A | 7/1981 | Haworth |
| 4,500,746 | A | 2/1985 | Meehan |
| 4,541,036 | A | 9/1985 | Landries |
| 4,612,603 | A | 9/1986 | Cook |
| 4,711,507 | A | 12/1987 | Noorily |
| 4,747,506 | A | 5/1988 | Stuchlik, III |
| 4,762,505 | A | 8/1988 | Asick |
| 4,775,328 | A | 10/1988 | McCarthy |
| 4,887,978 | A | 12/1989 | Murakami |
| 4,992,054 | A | 2/1991 | Cassan |
| 4,993,576 | A | 2/1991 | Byrne |
| 5,013,252 | A | 5/1991 | Nienhuis |
| 5,015,203 | A | 5/1991 | Furrow |
| 5,057,039 | A | 10/1991 | Persing |
| 5,073,120 | A | 12/1991 | Lincoln |
| 5,164,544 | A | 11/1992 | Snodgrass |
| 5,178,555 | A | 1/1993 | Kilpatrick |
| 5,203,712 | A | 4/1993 | Kilpatrick |

FOREIGN PATENT DOCUMENTS

| | | |
|---|---|---|
| DE | 2 316 582 | 12/1973 |

*Primary Examiner*—Khiem Nguyen
(74) *Attorney, Agent, or Firm*—Varnum, Riddering, Schmidt & HowlettLLP

(57) ABSTRACT

An electrical junction block is provided with a latching device adapted to engage a retaining tab in a support structure. The latching device includes a first cantilever beam extending from one edge of an upper surface of the junction block and having a free end extending beyond the centerline of the junction block and a tab channel in alignment with a centerline of the junction block. A second retention beam extends from a location adjacent an opposite edge of the upper surface of the junction block and overlaps a portion of the free end of the first cantilever beam. When a junction block provided with a latch of the present invention is inserted in a frame with a retaining tab, the junction block may be inserted from either of two opposite directions. When the junction block is inserted such that the retaining tab first engages the latch adjacent the one edge, the first cantilever beam is depressed against the tab until the tab channel is reached. When the junction block is inserted such that the retaining tab first engages the latch adjacent the opposite edge, the second retention beam will act to limit upward movement of the first cantilever beam, which would prevent proper insertion. A continued movement of the junction block toward the tab will cause the tab to depress the free end of the first cantilever beam until the tab is aligned with the tab channel.

7 Claims, 3 Drawing Sheets

MOUNTING ASSEMBLY WITH DUAL ENTRY CANTILEVER LATCH

CLAIM OF PRIORITY

Not applicable.

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFISHE APPENDIX

Not applicable.

BACKGROUND OF THE INVENTION

1. Field of the Invention

The invention relates to apparatus for mounting electrical junction blocks and the like and, more particularly, to an arrangement for mounting such devices in confined areas such as electrical raceways.

2. Description of Related Art

Modem office arrangements often employ removable wall panels or the like to define work areas. Such panels and other structures often have a raceway area for accommodating electrical wiring and electrical junction blocks near the floor or in other locations which do not provide easy access to technicians. Typically, junction blocks are mounted within such raceway areas by attaching them to support brackets. Since the electrical wiring requirements and locations of the junction blocks, some of which may include outlet boxes and the like, depend on the ever-changing needs of the users, junction blocks are often installed or removed after the wall panel structures are in place. Installing or removing a junction block positioned, for example, near the bottom of a wall panel and essentially at floor level, is often an arduous task. Furthermore, the only convenient access to a wall panel may be from only one side. Therefore, it is desirable that junction blocks are easily insertable and removable, and that they are insertable and removable from either side of the wall panel.

U.S. Pat. No. 4,993,576, issued Feb. 19, 1991 to the inventor of the present invention, shows a junction block provided with a latching mechanism comprising a pair of opposing interlocking members hingedly attached to a junction block and arranged to define a channel between opposing edges for engaging a retainer tab. A similar device is disclosed in U.S. Pat. No. 5,051,203 issued May 14, 1991 to Furrow. Junction blocks are typically constructed by adjoining two complementary, separately molded, half sections. The latching arrangement typically has one of the engaging sections molded as an integral part of one half section and the opposing part molded as an integral part of the other half section. The prior art latches comprise opposing and interlocking tongues and grooves. Unless special precautions are taken in the manufacture of these parts, the opposing sections may not be properly aligned, resulting in improper operation of the latch arrangements. A further disadvantage of such prior art arrangements is that a grooved section defined between the opposing edges tends to be reduced in size when the interlocking members are depressed, potentially causing a binding of the tab retained between the opposing edges of the interlocking members.

U.S. Pat. No. 5,259,787, issued Nov. 9, 1993 to the inventor of the present invention, and which is incorporated by reference herein, shows a junction block latching mechanism comprising a latch arm constructed as a cantilever beam. The cantilever beam extends from an outer wall of the junction block and is provided with a transversely extending channel for engagement with a retaining tab attached to a structural member designed to receive the junction block. A shortcoming of a latching mechanism employing such a cantilever beam construction is that it may be difficult to insert the junction block from one side of the frame due to the fact that the free end of the cantilever beam latch is raised to a position such that its ends abut against the tab, thereby preventing an easy installation.

SUMMARY OF THE INVENTION

These and other problems of the prior art are overcome in accordance with this invention by a latch member comprising a first cantilever beam and a second retention beam, the second retention beam being of a length differing from the first cantilever beam. The beams are attached to opposing sides of a junction block housing. The first cantilever beam is attached at a first hinge adjacent one side of the housing and extends to a position beyond the centerline of the housing. The second retention beam is attached adjacent an opposite side of the housing and extends from the opposite side to a position overlapping a portion of the upper surface of the first beam. The first cantilever beam is provided with a tab channel aligned with the centerline of the housing, for receiving a retainer tab or the like. An arm section of the first cantilever beam extends between the first hinge and the tab channel of the first cantilever beam, and a further arm section extends away from the first hinge and beyond the tab channel. The two arm sections of the first cantilever beam have sloping exterior surfaces, sloping upwardly toward the tab channel. The sloping surfaces cause the first cantilever beam to be flexed toward the upper wall of the junction block when the junction block is inserted in a raceway area in contact with a retainer tab or the like.

The second retention beam extends from an opposite side of the upper surface of the junction block and extends over a portion of the upper surface of the first cantilever beam toward the tab channel of the first cantilever beam, and is preferably terminated at or before the tab channel. Advantageously, when the junction block is inserted in a frame or the like from the side of the block adjacent the second retention beam, the second retention beam engages the retainer tab or the like and is positioned to exert a force on the free end of the first cantilever arm. In this manner, the second retention beam provides for proper engagement of the first cantilever arm with the retainer tab or the like. Advantageously, the dual beam latching device in accordance with the present invention eliminates a problem of the prior art in which the free end of a single cantilever beam can extend upwardly a sufficient distance so as to tend to engage a side wall of the retainer tab, thereby preventing proper engagement of the tab channel of the cantilever beam with the retainer tab.

In accordance with the present invention, a junction block may be readily disengaged from the side of the junction block which is opposite to the side at which the hinged section of the first cantilever beam attaches to the junction block. The disengagement can be undertaken by pivotal movement of the first cantilever beam about the first hinge, in a manner so that the retainer tab is disengaged from the tab channel. In the same manner, the junction block may be disengaged from the side of the junction block which corresponds to the side at which the hinged section of the first cantilever beam attaches to the junction block. Furthermore, the latch of the present invention overcomes the problem of prior dual, interlocking cantilever beams in that the alignment of the first cantilever beam and the second retention beam is not critical, thereby avoiding the problems encountered in assembly of junction blocks from complementary half sections.

BRIEF DESCRIPTION OF THE DRAWING

An illustrative embodiment of the invention is described in the following paragraphs with reference to the drawing, in which.

DETAILED DESCRIPTION

Figure 1:
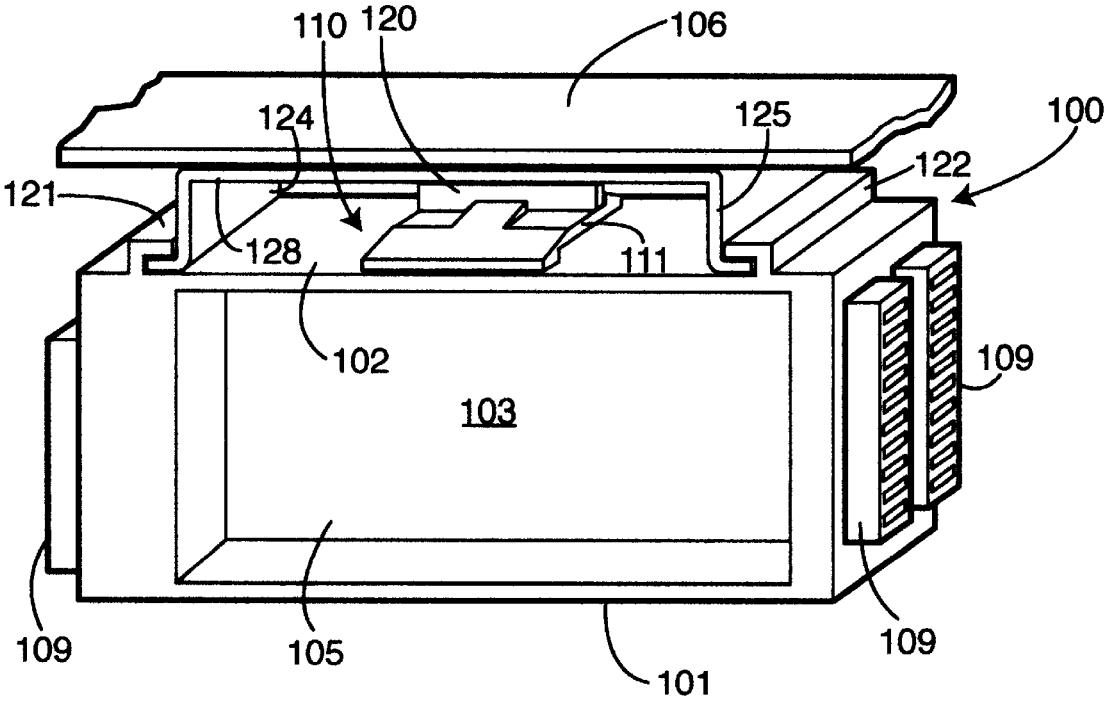
FIG. 1 is a perspective view of a junction block mounted on one type of support structure and incorporating principles of the invention.

FIG. 1 shows an illustrative embodiment of the invention in which an electrical junction block housing 100 (sometimes referred to herein as the "junction block") is supported on a structural member 106 by means of L-shaped mounting lugs 121, 122 on the housing 100. The lugs 121, 122 engage cooperating L-shaped brackets 124, 125 attached to the structural member 106. The structural member 106 may, for example, be the upper wall of a raceway in a wall panel or the like. The junction block housing 100 is provided with a substantially horizontally-extending lower wall 101 and a substantially parallel upper wall 102. A vertical wall 103 extending between the lower wall 101 and the upper wall 102 serves to divide a spatial area 105 from a similar area on the opposite side of wall 103. The spatial areas 105 are typically used to accommodate electrical outlet boxes or the like in the junction block housing. The junction block housing 100 may be connected to electrical circuits by means of electrical connectors 109 in a standard fashion. The junction block housing 100 is maintained in position relative to the structural member 106 by a retaining or "retainer" tab 120 mounted on the structural member 106 and engaging a latching device 110 disposed between mounting lugs 121, 122 on the upper wall 102 of the housing 100. The L-shaped brackets 124, 125 and the tab 120 may be formed with a plate 128 attached to the structural member 106.

Figure 2:
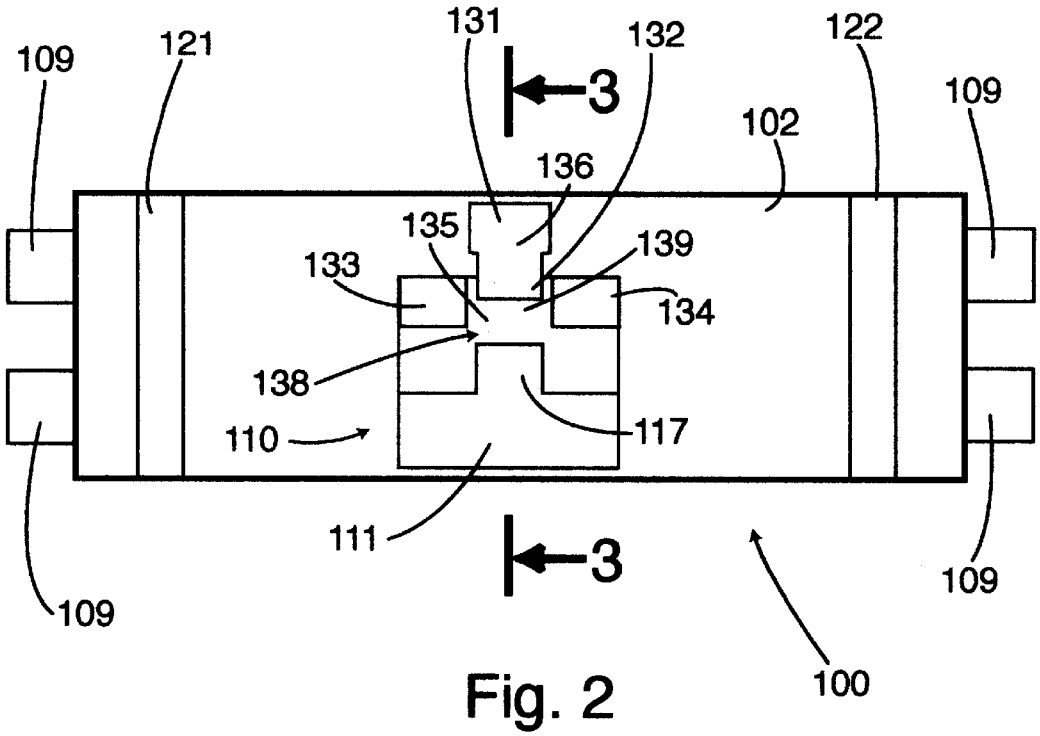
FIG. 2 is a top plan view of a junction block incorporating the latching mechanism of the invention.
Figure 3:
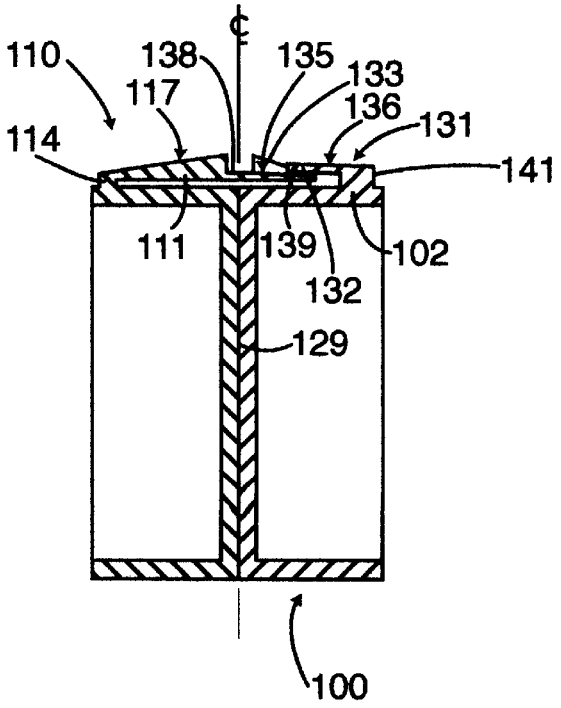
FIG. 3 is a cross-sectional view along line 3—3 of FIG. 2.

FIG. 2 is a top plan view of the junction block housing 100 removed from the structural member 106, the plate 128 and the retaining tab 120. The latching device 110 is shown as comprising a first cantilever beam 111 and a second retention beam 131 having an end portion 132 overlapping a portion of the first cantilever beam 111. FIG. 3 is a cross-sectional view of the latch mechanism of FIG. 2, taken along line 3—3. As depicted in the drawing, the first cantilever beam 111 extends from adjacent one side of the housing 100, and has one end attached to a hinged section or "hinge" 114. The first cantilever beam 111 extends toward and past a centerline 129 of the housing 100 and is provided with a first upwardly sloping surface 117, sloping upwardly from the hinge section 114 toward the centerline 129. Second and third raised portions 133 and 134 (only the second raised portion 133 is shown in FIG. 3) slope downwardly from the centerline 129 toward the opposite side of housing 100. A tab channel 138, as shown primarily in FIGS. 2 and 3, is formed between the second and third raised portions 133, 134, and the sloping surface 117 of the first cantilever beam 111. The second retention beam 131 is provided with the end portion 132 overlapping a relatively flat center portion 135 of the first cantilever beam 111, extending between the raised portions 133, 134 of first cantilever beam 111. The end portion 132 of the second retention beam 131 is connected to the upper wall 102 through an interconnection section 141, as depicted in FIG. 3. Although the interconnection section 41 may be characterized as somewhat of a "hinge," the second retention beam 131 is not required to be particularly resilient or otherwise "flexible" in movement, relative to the upper wall 102. In accordance with some of the primary principals of the invention, the second retention beam 131 primarily serves so as to maintain the first cantilever beam 111 in a position which allows for insertion of the junction block housing 100 in a direction from the left hand side to the right hand side as viewed in FIG. 3, relative to positioning of the junction block housing 100 with the retainer tab 120. The second retention beam 131 includes a surface 136, as shown primarily in FIGS. 2 and 3. The surface 136 is positioned in a substantially horizontal plane, and may or may not have somewhat of an upwardly sloping surface, with the slope extending upwardly from the interconnection section 141 toward the centerline 129. The relatively flat center portion 135 of the first cantilever beam 111 terminates in an end portion 139 which extends toward and below the end portion 132 of the second retention beam 131. In fact, the end portion 132 of the second retention beam 131 is exerting downward pressure on the first cantilever beam 111, thereby limiting upward movement of the beam 111. That is, in the configuration shown in FIG. 3, the first cantilever beam 111 will essentially be in a "tensioned" state, such that the first cantilever beam 111 would tend to rotate in a counter clockwise direction (as viewed in FIG. 3) relative to its hinge section 114 if the second retention beam 131 was absent.

As will be apparent from FIGS. 1 through 3, when the housing 100 is inserted from the front side, as depicted in FIG. 1, the tab 120 will first move above the substantially horizontal surface 136 of the second retention beam 131. As previously mentioned, the end portion 132 of the second retention beam 131 is exerting a downward pressure on the free end of the first cantilever beam 111 at the center portion 135 of the first cantilever beam 111. In this manner, the first cantilever beam 111 is being prohibited from any upward movement of the end portion 139, in a manner whereby the end portion 139 would contact the retainer tab 120, thereby preventing any further movement of the junction block housing 100. As the junction block 100 continues to be inserted, the sloping sections 133 and 134 of the first beam 111 will properly engage the retaining tab 120, thereby depressing the first cantilever beam 111. Further movement of the junction block 100 toward retaining tab 120 will result in further depression or downward movement of the first beam 111, in view of the angled or sloping configurations of the sloping sections 133 and 134. When the tab channel 138 formed between the sloping section 117 on the one side and sloping sections 133 and 134 on the other side of the first cantilever beam 111 is in alignment with the retaining tab 120, the resilient first cantilever beam 111 will tend to return to its prior position and the free end of tab 120 will be retained in the tab channel 138. That is, the first cantilever beam 111 will tend to pivot in a counter clockwise direction (as viewed in FIG. 3) about the hinged section 114. This pivotal movement will continue until the flat center portion 135 of the first cantilever beam 111 again engages the substantially horizontal surface 136 of the second retention beam 131. The relative configuration of the first cantilever beam 111 and the second retention beam 131 is such that in this position, the retaining tab 120 is retained in the tab channel 138. The foregoing is a description of the manner in which the junction block housing 100 could be inserted from the front side, as depicted in FIG. 1. This insertion will correspond to insertion of the housing 100 from the left side toward the centerline 129 as viewed in FIG. 3.

When the housing 100 is to be inserted from the opposite side (i.e., from the backside as depicted in FIG. 1, corresponding to insertion from the right side of the center line 129 as viewed in FIG. 3) such that the sloping surface 117 first engages the retaining tab 120, the first cantilever beam 111 will be increasingly depressed as the tab 120 engages the sloping surface 117, until the tab channel 138 is reached. When the tab channel 138 is reached, the first cantilever beam 111 will tend to return to its prior position, and the free end of tab 120 will be retained within the tab channel 138. Although the first cantilever beam 111 returns to its prior position, it is limited from any further upwardly movement by the second retention beam 131. In accordance with all of the foregoing, the latching device 110 provides for a retaining configuration which allows insertion of the junction block housing 100 from either direction, relative to the centerline 129. In particular, the use of the second retention beam 131 allows for insertion of the junction block housing 100 from the front side (as depicted in FIG. 1), without problems associate with the end portion 139 of the first cantilever beam 111 inappropriately abutting the retaining tab 120 during insertion.

For purposes of removing the housing 100, this removal can be undertaken, in accordance with the invention, from either of the two opposing sides of the support 106 and centerline 129. In either situation for removal, the removal is initiated by depressing or otherwise exerting downward pressure on the first cantilever beam 111. For example, if it is desired to remove the housing 100 from the front side, as depicted in FIG. 1 (corresponding to the left side as viewed in FIG. 3), the housing 100 may be removed by depressing the first cantilever beam 111 by any suitable device (such as a screwdriver or the like) by exerting pressure, for example, on the sloping surface 117. With pressure exerted on the sloping surface 117, the first cantilever beam 111 will be moved downwardly or otherwise depressed., in such a manner that the sloping sections 133 and 134 will be depressed below the bottom of the retaining tab 120, thereby allowing for the junction block housing 100 to be moved toward the left side, as viewed in FIG. 3.

If it is desired to remove the junction block housing 100 from the right side as viewed in FIG. 3 (e.g. from the backside as depicted in FIG. 1), the user will still initiate removal by depression of the first cantilever beam 111 by any suitable device, such as a screwdriver. For example, the user could exert pressure on either of the sloping sections 133 or 134. This downwardly exerted pressure will correspondingly depress the first cantilever beam 111. Depression of the first cantilever beam 111 will allow the uppermost edge of the sloping surface 117 to be positioned below the bottom of the retaining tab 120. In this manner, the junction block housing 100 may then be moved toward the right of the centerline 129 as viewed in FIG. 3. In accordance with the foregoing, and in accordance with the invention, the junction block housing 100, with the latch arrangement as described herein, is not only insertable from either of the two opposing sides of the support 106, but is also removable from either of the two opposing sides of the support 106.

Figure 4:
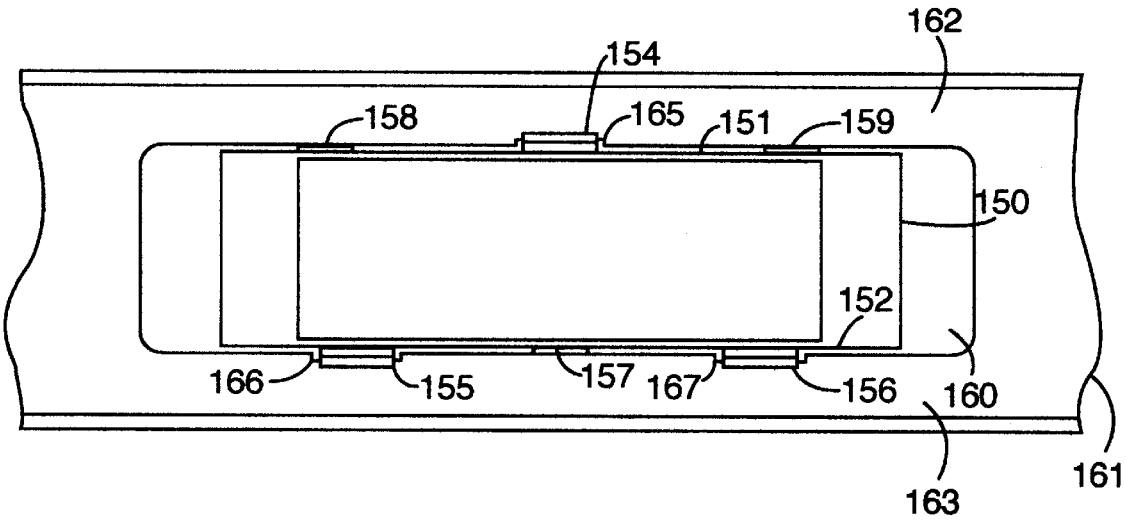
FIG. 4 is a side view of a junction block provided with a latching mechanism of the invention mounted on another type of junction block support structure.

FIG. 4 is a side view of a junction block 150 mounted within an opening 160 within a frame or structural member 161. The junction block 150 is provided with an upper wall 151 and a lower wall 152. Mounted on the upper wall is a latch member 154 such as previously described herein with reference to FIGS. 1 through 3. The latch member 154 is positioned for engagement with an upper rail 162 of the structural member 161. Further latching members 155 and 156 are mounted on the lower wall 152 and are positioned for engagement with a lower rail 163 of the structural member 161. The upper rail 162, in this particular example, is provided with a detent 165 in the area where the latching member 154 engages the upper rail. Similarly, the lower rail 163 is provided with detents 166 and 167 in the vicinity of latching members 155 and 156, respectively. One or more of these detents may be conveniently provided to prevent lateral movement of the junction block. A pair of spacing shoulders 158, 159, may be provided on upper wall 151 to reduce movement of the junction block and to better secure the junction block between the upper and lower rails 162, 163. A similar shoulder 157 may be provided on the lower wall 152.

Figure 5:
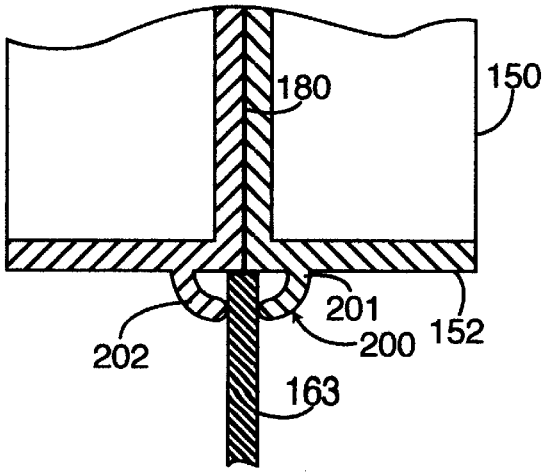
FIG. 5 is a partial cross-sectional view of a lower part of the junction block of FIG. 4, provided with a lower tab for engagement with a lower rail depicted in FIG. 4.

Alternatively, one of the walls 151, 152 may be provided with one or more engagement tabs, such as tab 200 shown in FIG. 5, such that one or more of the latch members as depicted in FIGS. 1 through 3 would be formed on only the other of the walls 151, 152. As an example, FIG. 5 shows a cross-sectional view of an alternate embodiment employing an engagement tab 200 on one of the walls of the junction block 150 generally depicted in FIG. 4. By way of example, the junction block 150 may be provided with a latch member 154 on its upper wall 151 and a tab 200 on its lower wall 152. The tab 200 is provided with a pair of arcuate arms 201, 202 which are spaced apart to allow tab 200 to extend over a portion of the lower rail 163. In this manner, tab 200 serves to retain block 150 in proper position relative to lower rail 163 while allowing a pivoting of block 150 during insertion and removal. One or more spacing shoulders, such as shoulders 158, 159, may be used on the upper wall 151 of housing 150. However, a spacing shoulder on the lower surface 152, such as shoulder 157 shown in FIG. 4, will generally not be used with tab 200.

In accordance with the foregoing, a mounting assembly is provided which allows a junction block housing to be readily engaged and disengaged from either side of a wall panel or other device to which a support for the junction block housing is attached. Mounting assemblies in accordance with the invention also facilitate ease of insertion and removal of the junction block housings. Still further, mounting assemblies in accordance with the invention overcome the problems of prior art systems which tend to bind during engagement and disengagement.

It will be apparent to those skilled in the pertinent arts that still other embodiments of mounting assemblies in accordance with the invention can be designed. That is, the principles of a mounting assembly in accordance with the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

The embodiments of the invention in which an exclusive property or privilege is claimed are defined as follows:

1. An electrical connection member for mounting on a structural support member, the electrical connection member comprising a housing having an outer wall having spaced apart first and second opposite side edges disposed equidistant from a longitudinally extending centerline of the housing and a latch member disposed on the outer wall for engagement with the structural support member, the latch member comprising:

a first cantilever beam comprising a first surface adjacent the outer wall and a second surface opposite the first surface, the first cantilever beam having a proximal end hingedly attached to the outer wall at a first cantilever beam hinge location disposed between the centerline and the first side edge and a free distal end terminating between the centerline and the second side edge and a transversely extending channel defined in the second surface and disposed in substantial alignment with the centerline for latching engagement with the structural support member; and a second retention beam comprising a first surface adjacent the outer wall and a second surface opposite the first surface of the second retention beam, the second retention beam having a proximal end attached to the outer wall at a second retention beam attachment location disposed between the centerline and the second edge and a free distal end terminating between the centerline and the second edge, a portion of the first surface of the free distal end of the second retention beam overlapping a portion of the second surface of the first cantilever beam adjacent the free distal end of the first cantilever beam.

2. The electrical connection member in accordance with claim 1 wherein the second surface of the first cantilever beam comprises a first part extending between the proximal end of the first cantilever beam and the channel and sloping upwardly away from the proximal end of the first cantilever beam and away from the outer wall, and a second part extending between the channel and the distal end of the first arm section and sloping toward the outer wall and toward the distal end, and wherein the portion of the first surface of the free distal end of the second retention beam laterally overlaps a portion of the second part.

3. The electrical connection member in accordance with claim 2 wherein the second part of the second surface comprises at least one portion sloping away toward the outer wall and toward the distal end at an angle greater than another portion of the second surface.

4. The electrical connection member in accordance with claim 1 wherein the channel comprises first and second oppositely directed channel side walls extending substantially perpendicular to the outer wall and the second surface of the first part of the first cantilever beam terminates in at least a portion of the first channel side wall and at least one portion of the second surface of the second part of the first cantilever beam extends from a portion of the second channel sidewall toward the distal end of the first cantilever beam.

5. The electrical connection member in accordance with claim 4 wherein the channel has a lower surface coincident with a portion of the second surface of the first cantilever beam adjacent the centerline, and the second surface of the first cantilever beam further comprises a surface portion extending between the lower surface and the distal end of the first cantilever beam.

6. The electrical connection member in accordance with claim 2 wherein the channel comprises a first sidewall section facing toward the distal end of the first cantilever beam and first and second spaced apart sidewall sections facing toward the proximal end of the first cantilever beam and each having an upper edge, and wherein the second part of the first cantilever beam comprises first and second spaced apart sloping surfaces extending from the first and second spaced apart sidewall sections toward the distal end of the first cantilever beam, and wherein the second part of the first cantilever beam further comprises a further portion of the second surface of the first cantilever beam extending between the first and second spaced apart sloping surfaces and from the channel toward the distal end of the first cantilever beam, and wherein the first surface of the second retention beam overlaps the further portion of the second surface of the first cantilever beam.

7. The electrical connection member in accordance with claim 6 wherein at least a portion of the first sidewall section is disposed in alignment with the further portion of the second surface of the first cantilever beam.

* * * * *